US006645429B1

(12) United States Patent
Raniwala

(10) Patent No.: US 6,645,429 B1
(45) Date of Patent: Nov. 11, 2003

(54) STERILIZATION SYSTEM AND METHOD FOR FOOD PACKAGING

(75) Inventor: Subodh Raniwala, Mundelein, IL (US)

(73) Assignee: The Quaker Oats Company, Chicago, IL (US)

( * ) Notice: Subject to any disclaimer, the term of this patent is extended or adjusted under 35 U.S.C. 154(b) by 0 days.

(21) Appl. No.: 09/481,106

(22) Filed: Jan. 11, 2000

(51) Int. Cl.[7] ..... A61L 9/00; A61L 2/00; B01D 11/04

(52) U.S. Cl. ..... 422/28; 422/32; 422/34; 422/260; 422/292; 422/300; 422/305

(58) Field of Search ..... 422/1, 5, 28–30, 422/32, 34–37, 120, 123–124, 357, 260, 285–286, 292, 300, 305–307, 900

(56) References Cited

U.S. PATENT DOCUMENTS 4,566,251 A * 1/1986 Spisak et al.
5,063,706 A * 11/1991 Aki et al.
5,635,132 A * 6/1997 Blanc
6,326,032 B1 * 12/2001 Richter et al.

* cited by examiner

*Primary Examiner*—Robert J. Warden, Sr.
*Assistant Examiner*—Monzer R. Chorbaji
(74) *Attorney, Agent, or Firm*—Ryndak & Suri

(57) ABSTRACT

A system and method for sterilizing to a desired level a food packaging area or room including the associated atmosphere that can be automated is provided. The method includes introducing the sterilizing agent as an aerosol suspension into the atmosphere of the food packaging area and exposed surfaces in the area, and then distributing the sterilizing agent to contact the surfaces therein that are to be sterilized with the sterilizing agent. The method may also include condensing the aerosol suspension to form a thin liquid film containing the sterilizing agent on exposed and nonexposed surfaces in the area or room to thereby effect sterilization of those surfaces.

36 Claims, 1 Drawing Sheet

STERILIZATION SYSTEM AND METHOD FOR FOOD PACKAGING

FIELD OF THE INVENTION

The present invention relates to a system and method for sterilizing a food packaging area, such as a food packaging clean room, by introducing a sterilizing agent into the atmosphere and contacting surfaces in the area with the sterilizing agent.

BACKGROUND OF THE INVENTION

Typically, food and beverage products are packaged by high-speed automated filling and packaging machines in a variety of different containers, such as bottles, cartons, boxes, cans, etc. It is advantageous and necessary in some cases, depending upon various factors, including for example, the type of food being packaged and the type of package, for the atmosphere surrounding the food packaging machines as well as various surfaces in the area to be sterilized prior to processing the food or beverage. For example, in processes for manufacturing ultimately shelf-stable products not subjected to undue heat, cold fill processes may require certain sterility.

The level of sterility can be measured in terms of classes which represent the number of particles per cubic meter. For example, cold filling certain preservative-free non-carbonated liquid beverages at temperatures of 120° F. or less into a bottle or other container may require such processing to occur in an area of Class 100 which signifies a maximum of 100 particles greater than 0.5 microns in size per cubic foot of air. Without such sterility, the end product may have a shorter shelf life or fail to meet certain Food and Drug Administration requirements. Additionally, sterilization of the atmosphere and surfaces in the area prior to the processing and packaging of foods and beverages, typically along with certain manufacturing practices, may eliminate the need to sterilize such foods and beverages post packaging. A closed environment, such as a clean room, is often used to minimize potential contamination and to substantially maintain a desired sterile environment level once it has been obtained.

Sterilizing the food processing or packaging machines and the surrounding area causes destruction of microorganisms, including bacteria and certain types of spores. This, in turn, minimizes the risk of contamination of the food product and the spoilage rate of the food product, among other things. A need exists for an effective method of sterilizing a large area including food processing or food packaging machinery. As used herein, "sterilization" does not necessarily mean complete elimination of microorganisms, and as known to those skilled in the art, there are levels of sterilization (such as numbers of microorganisms in the atmosphere per cubic volume).

It is known to manually apply liquid sterilizing agents and solutions on exposed surfaces, such as on food packaging equipment and to the floor surrounding the food packaging equipment. For example, this has been achieved by application through a hose or mop directly on the desired equipment or surface. However, such a method is time and labor intensive and cannot ensure that either the surrounding atmosphere or nonexposed surfaces of the equipment have been sterilized.

A need exists for a less labor intensive method for sterilizing a food packaging area that is reliable and easily repeatable. A need exists for a method for sterilizing a food packaging area that is less time consuming. A need also exists for a precise method of obtaining a desired level of sterility in the atmosphere and all surfaces of food packaging equipment and the room containing that equipment. Merely applying a liquid sterilizing agent to equipment does not provide uniform exposure to all areas of the food packaging equipment and the surrounding atmosphere of the room, such as in a clean room, for example. A need exists to sterilize the nonexposed surfaces and the atmosphere in the room, and to minimize the waste of the sterilizing agent during the sterilization process.

SUMMARY OF THE INVENTION

In accordance with one aspect of the present invention, a method of sterilizing a food packaging area or room is provided that is especially suited for automation. This method comprises introducing a sterilizing agent into the atmosphere of the food packaging area or room to create an aerosol suspension containing the sterilizing agent and distributing the atmospheric aerosol suspension for a sufficient time and in a sufficient concentration to reduce the microorganism concentration in the atmosphere to desired levels and on the surfaces in the area that are to be sterilized. Typically, the desired level of sterility is to achieve sterilization in the area. The sterilizing agent is preferably contained in an aerosol suspension and condenses on various surfaces. By "aerosol", applicant means a suspension of liquid particles in the atmosphere, which particles may be in the colloidal size range (typically the colloidal size range is about 1 millimicron to about 1 micron), such as a gas, fog, mist, or fine spray or droplet.

For purposes of the present invention, "surface(s)" refers to the surface(s) of the walls, floor, ceiling, food processing equipment and any other thing present in the area or room that is exposed to the atmosphere of the area or room (i.e., air in the room contacts the surface of the walls and floor), the surface of which is to be sterilized. For purposes of the present invention, "exposed surface(s)" refer to any surface (s) that are readily accessible to direct spraying. For purposes of the present invention, "nonexposed surface(s)" refers to any surface(s) which are not readily accessible to direct spraying. For example, a box with spaced apart slats would contain exposed surfaces on the outside of the box and nonexposed surfaces which are inside the slats on the box yet still open to the atmosphere. It should be noted that the box in this example may contain parts which are neither exposed surfaces nor nonexposed surfaces if interior portions are completely isolated from the atmosphere. A vented enclosure for equipment may have exterior surfaces that are "exposed" and interior surfaces that are unexposed but open to the atmosphere and hence a "nonexposed surface" in accordance with the invention. Similarly, a surface such as the interior of an incandescent bulb or cathode ray tube is neither an "exposed surface" nor a "nonexposed surface" and for purposes of the invention is a "closed surface" (i.e., a surface that is not exposed to the atmosphere). The present invention is not applicable to such closed surfaces.

In accordance with the present invention, the sterilizing agent may be introduced directly into the atmosphere as an aerosol suspension, preferably in the form of small droplets or a fog that condense on a surface (and are readily evaporable) to react with and/or kill microorganisms. While not wishing to be bound by theory, it is believed that sterilizing agent reacts with microorganisms when the sterilizing agent condenses on a surface, and may also react by contacting the microorganisms in the atmosphere without condensing. Preferably, the aerosol suspension condenses on all or substantially all (or as otherwise desired or needed) of the exposed surfaces to be sterilized in the food packaging area or room. The sterilizing agent is distributed throughout the area to ensure that the atmosphere and substantially all of the exposed and nonexposed surfaces are sterilized to a desired level. No circulation is accomplished in the atmosphere in the area or room to maintain high concentration of the sterilizing agent. After the sterilizing agent is present for at least a sufficient period of time to accomplish the desired degree of sterilization, the sterilizing agent may be removed from the area, leaving a resulting atmosphere and surfaces that have a sufficient sterility for a given purpose. Generally, removal of the sterilizing agent to some threshold level is necessary prior to unprotected personnel entering the area. This method can provide for more precise control over the sterility of the room than the prior art.

In accordance with another aspect of the invention, the sterilizing agent is a liquid sterilizing agent that is evaporable without leaving any residue or any substantial residue. One such sterilizing agent is known as Oxonia™, which is an aqueous mixture of hydrogen peroxide, peracetic acid and inert ingredients. The sterilizing agent can be diluted as desired with an appropriate carrier liquid, such as water.

In accordance with another aspect of the invention, atmospheric conditions in the area or room to be sterilized are controlled such that the sterilizing agent, after introduction into the area or room, condenses on surfaces, including on exposed and unexposed surfaces, in the area or room to be treated.

In accordance with another aspect of the present invention, an automated sterilization system is provided that can practice the foregoing sterilization methods and eliminates the need for manual application of the sterilizing agent. Such a system can be more economical, reliable and repeatable than a manual system.

In accordance with another aspect of the present invention, the method of sterilization may be operated in a cold filling liquid product filling operation.

DETAILED DESCRIPTION OF THE INVENTION

Figure 1:
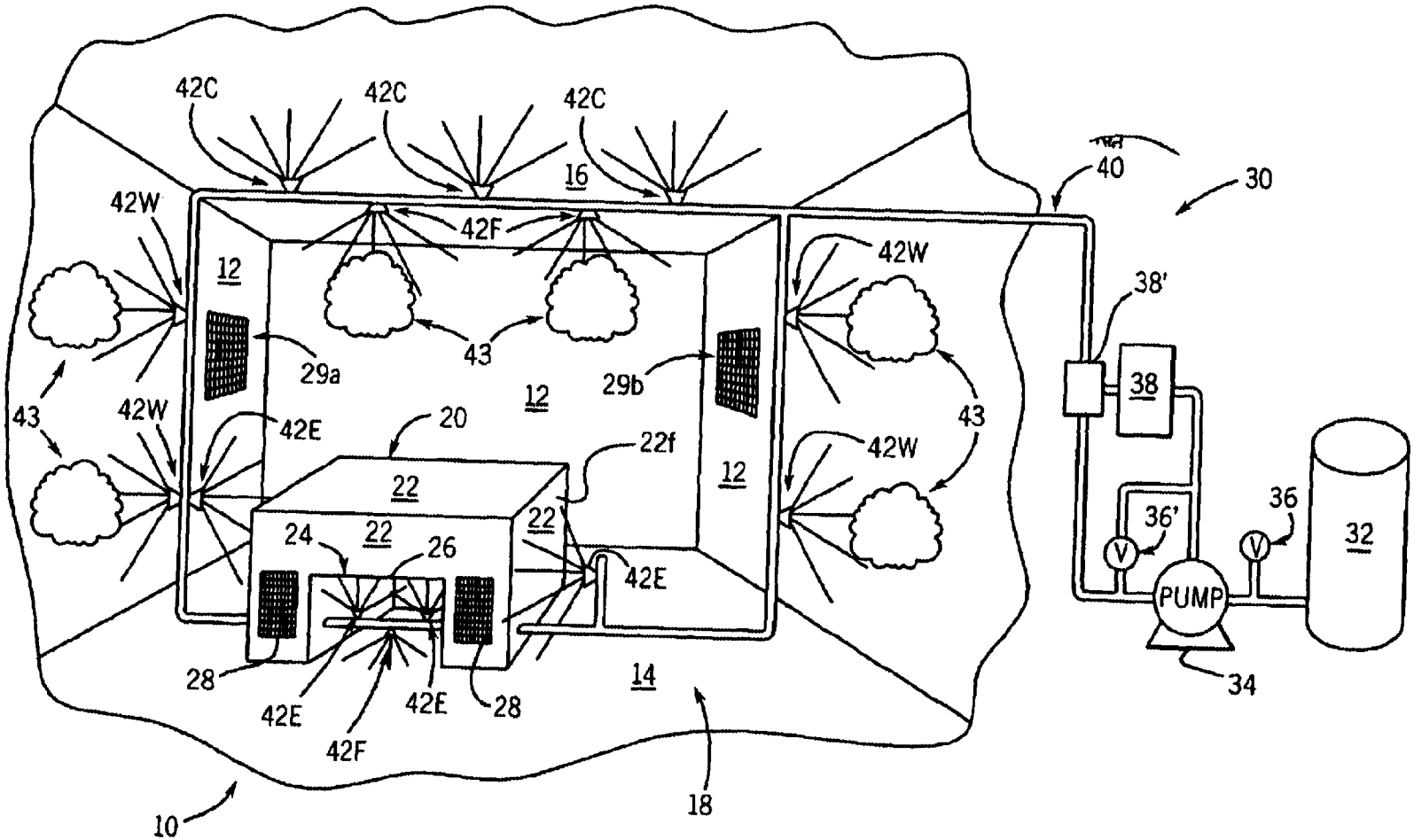
FIG. 1 is an elevation view of a system for sterilizing a closed food packaging area in accordance with the invention.

The present invention provides a method and system of reducing the level of microorganism concentration in a food or beverage processing or packaging area, including sterilizing the atmosphere and substantially all exposed and nonexposed surfaces in the area. The environment may be a closed system, such as a clean room, an enclosed room or series of clean rooms or enclosed rooms, or a partially open system. One example of a partially open system is a continuous (non-batch) method of filling containers where containers are transported into and out of sterile areas. When a series of clean rooms is used, each room may be used for a different processing or packaging purpose, such as one room for filling a product into a container and one room for capping the container. Each clean room within a series may require or necessitate a different level of cleanness. For example, the series of clean rooms may have the following required levels of sterility, Class 1000, 100, 100 for operator walkway, rinsing, and filling of beverage containers, respectively.

One embodiment of the present invention is illustrated in FIG. 1. FIG. 1 illustrates in fragmentary view a food packaging room 10. Food packaging room 10 consists of walls 12, a floor 14, a ceiling 16 and an atmosphere 18 which in this case is air. Food packaging room 10 contains food packaging equipment 20 which is shown in schematic form. Food packaging equipment 20 includes exposed surfaces 22 which, for example, are located on the top and sides of food packaging equipment 20 as well as on a raised underside portion 24 of food packaging equipment 20. Food packaging equipment 20 also includes nonexposed surfaces 26 located behind vents 28 of food packaging equipment 20. An HVAC system 29 represented by inlet and outlet vents 29*a* and 29*b*, respectively, for providing heating, cooling, ventilating and air filtration is part of room 10. HVAC system 29 can form part of the sterilizing system for room 10 as hereinafter described, for either purging the sterilizing agent from atmosphere 18 and/or for introducing the sterilizing agent into atmosphere 18. HVAC system 29 also includes a HEPA filter (not shown) and permits outside HEPA filtered air to be introduced into room 10 while exhausting air leaving atmosphere 18 to the outside atmosphere.

FIG. 1 illustrates a sterilizing system 30, which in the illustrated embodiment consists of a tank 32, a pump 34, valves 36 and 36', a control system 38 and pressure and flow sensor 38', piping 40 and fixed spray nozzles 42C, E, F and W.

Tank 32 contains a sufficient quantity of sterilizing solution to effect sterilization of food packaging room 10 and may incorporate a heater (not shown) for heating the sterilizing agent contained therein to a desired temperature, such as about 75 to about 180° F.

Pump 34 pumps the sterilizing solution from tank 32 through piping 40 and nozzles 42 located in food packaging room 10. A pneumatic head on nozzles 42 atomizes the sterilizing solution into an aerosol suspension, a vapor or fog 43. In the alternative, aerosol suspension 43 can be generated by a stand alone fogging machine or any other method of aerosol suspension generation known to those skilled in the art. Control system 38 and pressure and flow sensor 38' control the pressure and flow rate of sterilizing solution pumped through nozzles 42.

Nozzles 42 are arrayed and mounted in fixed locations to provide maximum coverage on walls 12, floor 14, ceiling 16 and food packaging equipment 20, including on nonexposed surfaces 26 at raised underside portion 24 of food packaging equipment 20. More specifically, nozzles 42C are dedicated to applying the aerosol suspension to the entire exposed surface of ceiling 16, nozzles 42W are dedicated to applying the aerosol suspension to the entire exposed surface of walls 12, nozzles 42F are dedicated to the entire exposed surface of floor 14, as well as line of sight exposed surfaces 22F of food packaging equipment 20. Nozzles 42E are dedicated to applying aerosol suspension 43 to various exposed surfaces 22 of food packaging equipment 20 as indicated in FIG. 1. Any suitable type of nozzle can be used to achieve the desired introduction of the sterilizing agent into the area or room, and preferably an atomizing type nozzle is used.

Nozzles 42 also introduce the sterilizing agent into atmosphere 18 of food packaging area 10. Nozzles 42 can provide a liquid droplet so that the sterilizing agent readily evaporates into atmosphere 18 to form an aerosol suspension 43. The aerosol suspension 43 may condense when it comes into contact with exposed or nonexposed surfaces because of the temperature differential between such surfaces and the aerosol suspension. The humidity, concentration of sterilizing agent and temperature of atmosphere 18 can be adjusted so that condensation of sterilizing agent on surfaces 22 and 26 is maximized.

Alternatively, spray nozzles or other structure to inject sterilizing agent into the atmosphere and/or on surfaces to be sterilized could be movable or contained on a movable device that traverses the room, (e.g., across the floor or suspended from the ceiling and/or walls) such as on a motorized wheeled vehicle or robot, for example.

In accordance with the system and method of the invention, the sterilizing agent may be introduced to atmosphere 18 in the form of an aerosol suspension, gas, fog or mist. Such introduction could be accomplished through HVAC system 29 or through a separate system, for example.

After introduction, the sterilizing agent is allowed to remain in atmosphere 18 for at least a sufficient time to provide the desired level of sterilization. During this time, the sterilizing agent reacts with and/or kills microorganisms by contact with exposed and nonexposed surfaces 22 and 26 within the area or room 10. Later, the sterilizing agent may be substantially removed or purged from atmosphere 18, preferably replaced with filtered air (such as with a HEPA 99.97% filter), or other air that is free or substantially free of microorganisms to the desired degree.

The sterilizing agent preferably is a compound or element which is effective for removing, reducing or otherwise rendering harmless microorganisms and is capable of evaporating without leaving a residue or a substantial residue on surfaces. Examples include Vortexx™ (of Ecolab Inc. of St. Paul, Minn.) and peroxyacetic acid compositions. A preferred sterilizing agent is Oxonia™. Oxonia™, a trademark of Ecolab Inc. of St. Paul, Minn., comprises an aqueous mixture of 27.5% hydrogen peroxide, 66.7% inert ingredients and 5.8% peracetic acid and is preferably present to its saturation level in the area.

The sterilizing agent may be provided and stored in any suitable manner, such as in bulk (such as in a tank, vat or other storage device) or mixed in line with a water source, for example, which is isolated in some manner from the atmosphere to be treated. The sterilizing agent may also be stored at ambient or elevated temperature. Some sterilizing agents perform better at an elevated temperature. In addition, injecting the sterilizing agent at elevated temperature into the atmosphere of the area or room facilitates its evaporation into the atmosphere, thereby increasing the sterilizing agent concentration and facilitating condensation of the sterilizing agent on exposed and unexposed surfaces when desired. In addition, condensation of the sterilizing agent on the exposed and unexposed surfaces can be facilitated by raising the atmospheric temperature in the area or room to be treated above the temperature of the surfaces in the area or room, providing a concentration of sterilizing agent and water in the atmosphere such that condensation from the atmosphere forms at least a thin liquid film on the surfaces (preferably both exposed and unexposed) of the area or room, such as on the walls 12, floor 14, ceiling 16 and equipment surfaces 20 and 26, thereby providing a sterilizing effect on those surfaces, without requiring either direct spray or other atmospheric contact. Depending upon the sterilizing agent used, the agent may be diluted as desired. For example, in the preferred embodiment, between 2–3% Oxonia™ is diluted to a 2–3% aqueous Oxonia™ solution at between about 75° F. and 130° F.

In accordance with the method of the invention, when sterilization of the food packaging area is to be initiated, the sterilizing agent is introduced into the area. The sterilizing agent may be introduced into the area by injecting an aerosol suspension, gas, a fog or a mist or by spraying droplets into the atmosphere of the area or room as well as directly on the surfaces of the area or room, or by combination thereof, or any other like method.

In the preferred embodiment, the nozzles are configured such that the aerosol suspension directly condenses and wets the maximum amount of the exposed surfaces in the area. The nozzles may spray in any direction. For example, depending on the orientation of equipment or other items in the area, nozzles may be mounted below the equipment and spray in an upwardly direction. The nozzles should have a desired spraying angle to effectively apply the antimicrobial composition. The nozzle location and spray angles depend upon, for example, the configuration of the equipment and room or area to be sprayed. Generally, the nozzles should be located and positioned to obtain maximum distribution of the sterilizing agent directly on the exposed surfaces and in the atmosphere. The nozzles may be fixed or rotatable.

The sterilizing agent may be introduced into the area as an aerosol suspension, gas, mist, vapor or in a liquid droplet form. For example, a microprocessor can be used in sterilizing system 30 of FIG. 1 to automatically initiate and operate a sterilization cycle. Preferably, direct spraying of the exposed surfaces in the room with the sterilizing agent should be maximized, which can occur by condensation of the sterilizing agent both on exposed and nonexposed surfaces in the area. The contact can occur in the gas phase, or, if conditions are suitable, in a liquid phase as a result of condensation of the sterilizing agent on surfaces. The desired concentration of sterilizing agent in the atmosphere depends upon the type of sterilizing agent used and the size of the room to be sterilized, among other things. In a sterilization process, the concentration of the sterilizing agent must be sufficient so that where the agent contacts a surface, it sterilizes that surface. For Oxonia™, the preferred atmospheric composition of Oxonia™ is at the saturation level of the room. The necessary concentration of the sterilizing agent and frequency of the sterilization can be obtained by reviewing historical data for the area.

Generally, the sterilizing agent will be introduced into the clean room or area for a predetermined amount of time, such as for 30 minutes or until a desired concentration of sterilizing agent is provided in the atmosphere. The tubes or lines containing the sterilizing agent may be purged thereafter to remove any residual agent from the nozzles. Then, the sterilizing agent is distributed throughout the area to achieve contact with microorganisms for a sufficient amount of time to achieve a desired level of sterility.

After this contact time, the remaining sterilizing agent may be removed from the atmosphere. The sterilizing agent may be removed by any suitable means such as by heating the room to evaporate the sterilizing agent and thereafter purging the atmosphere in the room or area to the external atmosphere, for example. Preferably, to purge the atmosphere, clean, microorganism-free (to a desired level) air is introduced into the room or area to replace the atmosphere containing the sterilizing agent. For example, when Oxonia™ is used, the room may be heated to evaporate all Oxonia™ on exposed and nonexposed surfaces and then the atmosphere may be evacuated until the hydrogen peroxide concentration in the area is less than 0.5 ppm. Evaporating the Oxonia™ does not leave a residue. This entire process may be periodically repeated as often as desired to maintain or obtain a certain sterility based on historical data or by directly monitoring sterilizing agent concentration and/or microorganism concentration in the atmosphere.

While the invention has been described with respect to certain preferred embodiments, as will be appreciated by those skilled in the art, it is to be understood that the invention is capable of numerous changes, modifications and rearrangements and such changes, modifications and rearrangements are intended to be covered by the following claims.

I claim:

1. A system for sterilizing a food packaging area comprising:

a food packaging area having exposed surfaces including ceiling, wall and floor surfaces and packaging equipment located and contained within the food packaging area, the packaging equipment having exposed and nonexposed surfaces;

a source of a sterilizing agent;

means for introducing the sterilizing agent into the atmosphere of the food packaging area to create an aerosol suspension containing the sterilizing agent and to contact substantially all of the exposed and nonexposed surfaces to be sterilized in the food packaging area, the means for introducing the sterilizing agent being capable of supplying the sterilizing agent in the area in sufficient concentration to reduce the microbial concentration in the atmosphere and on the surfaces contacted by the sterilizing agent contained in the food packaging area; and means for condensing sterilizing agent on at least substantially all exposed surfaces in the food packaging area that are to be sterilized and for contacting substantially all nonexposed surfaces in the area that are to be sterilized by contact with the sterilizing agent contained in the food packaging area.

2. The system of claim 1 where the aerosol suspension condenses to form at least a thin liquid film on at least one exposed surface to be sterilized in the area.

3. The system of claim 1 wherein the means for introducing includes structure for spraying the sterilizing agent into the food packaging area in a form selected from the group consisting of an aerosol suspension, a fog, a vapor and a mist.

4. The system of claim 3 wherein the structure for spraying includes a plurality of nozzles located in the packaging area for introducing the sterilizing agent into the atmosphere.

5. The system of claim 1 wherein the source of a sterilizing agent is a fog generator.

6. The system of claim 1 wherein the sterilizing agent forms a thin liquid film on the surfaces to be sterilized.

7. The system of claim 1 wherein the food packaging area is an enclosed room.

8. The system of claim 7 wherein the temperature of the sterilizing agent is between 75° F. and 130° F.

9. The system of claim 1 wherein the sterilizing agent comprises hydrogen peroxide, inert ingredients and peracetic acid.

10. The system of claim 1 wherein the sterilizing agent is evaporable.

11. The system of claim 1 further comprising means for substantially removing the agent from the atmosphere after the area is sufficiently sterile.

12. The system of claim 11 wherein said means for removing the agent includes a ventilation system for introducing microorganism-free air into said area.

13. The system of claim 1 wherein the means for introducing the sterilizing agent into the atmosphere is automated.

14. The system of claim 13 wherein a microprocessor automatically initiates and operates said sterilization cycle.

15. The system of claim 1 wherein the means for condensing the sterilizing agent includes means for controlling the conditions of said area to promote condensation.

16. The system of claim 15 wherein the conditions are selected from the group consisting of the temperature of the sterilizing agent, the temperature of the area, the humidity of the area and combinations thereof.

17. A method for sterilizing a food packaging area having surfaces to be sterilized and a food packaging machine comprising:

introducing a sterilizing agent as an aerosol suspension into the atmosphere of the food packaging area having exposed surfaces including ceiling, wall and floor surfaces and packaging equipment located and contained within the food packaging area, the packaging equipment having exposed and nonexposed surfaces;

condensing sterilizing agent on substantially all of the exposed surfaces and contacting with the sterilizing agent substantially all of the nonexposed surfaces that are to be sterilized in the food packaging area;

maintaining the sterilizing agent within the atmosphere of the food packaging area for a fixed period of time sufficient to reduce to a desired level the amount of active microorganisms in the atmosphere and on substantially all the exposed and nonexposed surfaces in the food packaging area; and substantially removing the sterilizing agent from the atmosphere of the food packaging area so that the resulting atmosphere and food packaging area are sufficiently sterile.

18. The method of claim 17 wherein said introducing the sterilizing agent comprises spraying the sterilizing agent into the atmosphere.

19. The method of claim 17 further comprising forming a thin liquid film on at least one surface in the area.

20. The method of claim 19 wherein the sterilizing agent is introduced in gaseous form into the atmosphere.

21. The method of claim 19 wherein the form of the sterilizing agent introduced is selected from the group consisting of an aerosol suspension, a gas, a mist and a fog, at least a portion of the sterilizing agent evaporating into the atmosphere.

22. The method of claim 17 wherein the temperature of the atmosphere is adjusted to promote said condensing.

23. The method of claim 17 wherein the humidity and the concentration of sterilizing agent is controlled to promote said condensing.

24. The method of claim 17 further comprising spraying the sterilizing agent in liquid form on at least a portion of the surfaces to be sterilized in the area.

25. The method of claim 17 wherein the sterilizing agent comprises hydrogen peroxide, inert ingredients and peracetic acid.

26. The method of claim 25 wherein said removing the sterilizing agent further comprises evaporating the sterilizing agent from the area.

27. The method of claim 26 further comprising purging the area with microorganism-free air.

28. The method of claim 17 wherein the sterilizing agent comprises about 27.5% hydrogen peroxide, about 66.7% inert ingredients and 5.8% peracetic acid.

29. The method of claim 17 wherein the food packaging area is enclosed.

30. The method of claim 17 wherein the method is operated in a cold filling liquid product filling operation.

31. The method of claim 17 wherein the condensing causes the sterilizing agent to condense on substantially all exposed and nonexposed surfaces that are to be sterilized in the food packaging area.

32. The method of claim 17 wherein said removing the sterilizing agent further comprises heating the area to evaporate the sterilizing agent.

33. The method of claim 32 further comprising purging the area with microorganism-free air.

34. A system for sterilizing a food packaging room comprising:

a food packaging area having exposed surfaces including ceiling, wall and floor surfaces and packaging equipment located and contained within the food packaging area, the packaging equipment having exposed and nonexposed surfaces;

a source of an evaporable sterilizing agent;

a sterilizing agent delivery system connected to the source of sterilizing agent for introducing the evaporable sterilizing agent into the food packaging atmosphere to create a fog containing the sterilizing agent to contact with substantially all of the exposed and nonexposed surfaces to be sterilized in the food packaging area, wherein the delivery system can supply the sterilizing agent in sufficient quantity and concentration to reduce the microbial concentration in the atmosphere and on at least substantially all the surfaces contacted by the atmosphere containing the sterilizing agent; and means for distributing the sterilizing agent to condense on at least substantially all exposed surfaces in the food packaging area and to contact on at least substantially all nonexposed surfaces.

35. The system of claim 34 wherein the sterilizing agent delivery system includes a plurality of nozzles mounted in the room and arrayed to spray at least an aerosol suspension that condenses to form a thin liquid film on substantially all the surfaces to be sterilized.

36. The system of claim 35 wherein at least one of the nozzles is capable of spraying the underside of the equipment with said sterilizing agent.

* * * * *